United States Patent [19]

Eller

[11] 4,073,606

[45] Feb. 14, 1978

[54] PUMPING INSTALLATION

[76] Inventor: J. Marlin Eller, 204 NE. 8th Terrace, Deerfield Beach, Fla. 33441

[21] Appl. No.: 759,895

[22] Filed: Jan. 17, 1977

Related U.S. Application Data

[63] Continuation-in-part of Ser. No. 629,519, Nov. 6, 1975, abandoned.

[51] Int. Cl.[2] ..... F04D 29/10

[52] U.S. Cl. ..... 417/424; 64/23; 415/111; 415/170 A

[58] Field of Search ..... 417/424, 360; 415/110, 415/111, 122, 170 A, 501; 64/23

[56] References Cited

U.S. PATENT DOCUMENTS

| | | | |
|---|---|---|---|
| 1,170,512 | 2/1916 | Chapman | 415/501 |
| 1,926,446 | 9/1933 | Klosson | 417/424 |
| 2,237,027 | 4/1941 | Dorer | 417/424 |
| 2,801,083 | 5/1957 | Balassa | 417/424 |
| 2,865,295 | 12/1958 | Laing | 417/424 |
| 2,868,132 | 1/1959 | Rittershofer | 417/360 |
| 2,885,964 | 5/1959 | Lung | 417/424 |
| 3,673,816 | 7/1972 | Kuszaj | 64/23 |
| 3,704,960 | 12/1972 | Zagar | 417/424 |
| 3,771,926 | 11/1973 | Paddieck | 417/424 |
| 3,847,504 | 11/1974 | Martin | 417/424 |
| 3,914,072 | 10/1975 | Rowley | 415/170 A |
| 3,949,567 | 4/1976 | Stech | 415/122 R |
| 3,957,403 | 5/1976 | Sloan | 415/170 A |

FOREIGN PATENT DOCUMENTS

| | | | |
|---|---|---|---|
| 698,696 | 11/1964 | Canada | 417/424 |
| 906,008 | 12/1945 | France | 417/424 |
| 426,815 | 11/1947 | Italy | 417/424 |

*Primary Examiner*—C. J. Husar
*Attorney, Agent, or Firm*—Oltman and Flynn

[57] ABSTRACT

In a pumping installation having an above-ground prime mover driving an axial-flow pump below through a relatively long drive shaft unit, the drive shaft unit is coupled to the pump shaft through a sliding coupling which accommodates axial expansion and contraction of the relatively long drive shaft unit due to temperature changes. The pump shaft is provided with combined rotational and axial thrust bearings for taking up axial thrusts in either direction, and an improved shaft seal is provided for the pump shaft.

13 Claims, 9 Drawing Figures

76
84
83
77a
85
86
78
79
80
10
12a
14
12
14
13
2
11
93
51
93
90a
90a
2
12a
92
90
13
14
14a
15
17a
15a
16
18
46
45
22
24
17
28
29
23
27
25
30
44
26
42
41
43
31
43
36
K
32
35
37
47
48
50
63
65
20
33
72c
49
64
50
72
72a
52
71
72b
53
55
70d
51
70
61
70a
70b
70e
70c
62
73
54
75
74
20b
S
58
76a
59
59
76
60
84
77
83
85
57
78
69
79
56
80
66
67
68
81
82
67
90a
90a
91
90

PUMPING INSTALLATION

CROSS REFERENCE TO RELATED APPLICATION

This application is a continuation-in-part of my copending U.S. patent application, Ser. No. 629,519, filed Nov. 6, 1975, now abandoned.

BACKGROUND OF THE INVENTION

Prior to the present invention, pumping installations have been used in which an electric motor or other prime mover, located above ground, drives an axial flow pump, located below ground, through a relatively long drive shaft unit which is several feet in length. The drive shaft unit typically comprises several shafts connected end to end by screw-threaded couplings. In such pumping installations, the drive shaft unit expands and contracts longitudinally with temperature changes and it tends to vibrate transversely. Both of these factors tend to cause malfunctioning or rapid wear at the pump shaft seal, usually because the seal cuts a groove in the pump shaft, with subsequent leakage there. In actual practice, repair and replacement of the shaft seal and the pump shaft has been a major maintenance expense in prior underground pumping installations. Proper operation of the shaft seal is very important because of the presence of foreign particles in the water being pumped.

SUMMARY OF THE INVENTION

The present invention is directed to an improvement in pumping installations which is constituted by the combination of:

(1) a shaft coupling at the lower end of the drive shaft unit which permits the latter to expand and contract longitudinally without imparting such expansions and contractions to the pump shaft just below;

(2) a particular bearing arrangement for the pump shaft which substantially prevents it from vibrating transversely; and (3) a carbon-ceramic shaft seal for the pump shaft located just below this bearing and capable of providing a more effective sealing operation over a long period of operation and without producing substantial wear on the pump shaft.

A principal object of this invention is to provide a novel and improved arrangement in an axial-flow pumping installation for minimizing the previously experienced disadvantages associated with the long drive shaft unit.

Further objects and advantages of this invention will be apparent from the following detailed description of presently-preferred embodiments thereof, which are shown in the accompanying drawings, in which.

Before explaining the disclosed embodiments of the present invention in detail, it is to be understood that the invention is not limited in its application to the details of the particular arrangements shown, since the invention is capable of other embodiments. Also, the terminology used herein is for the purpose of description and not of limitation.

Figures 1, 2, 3:
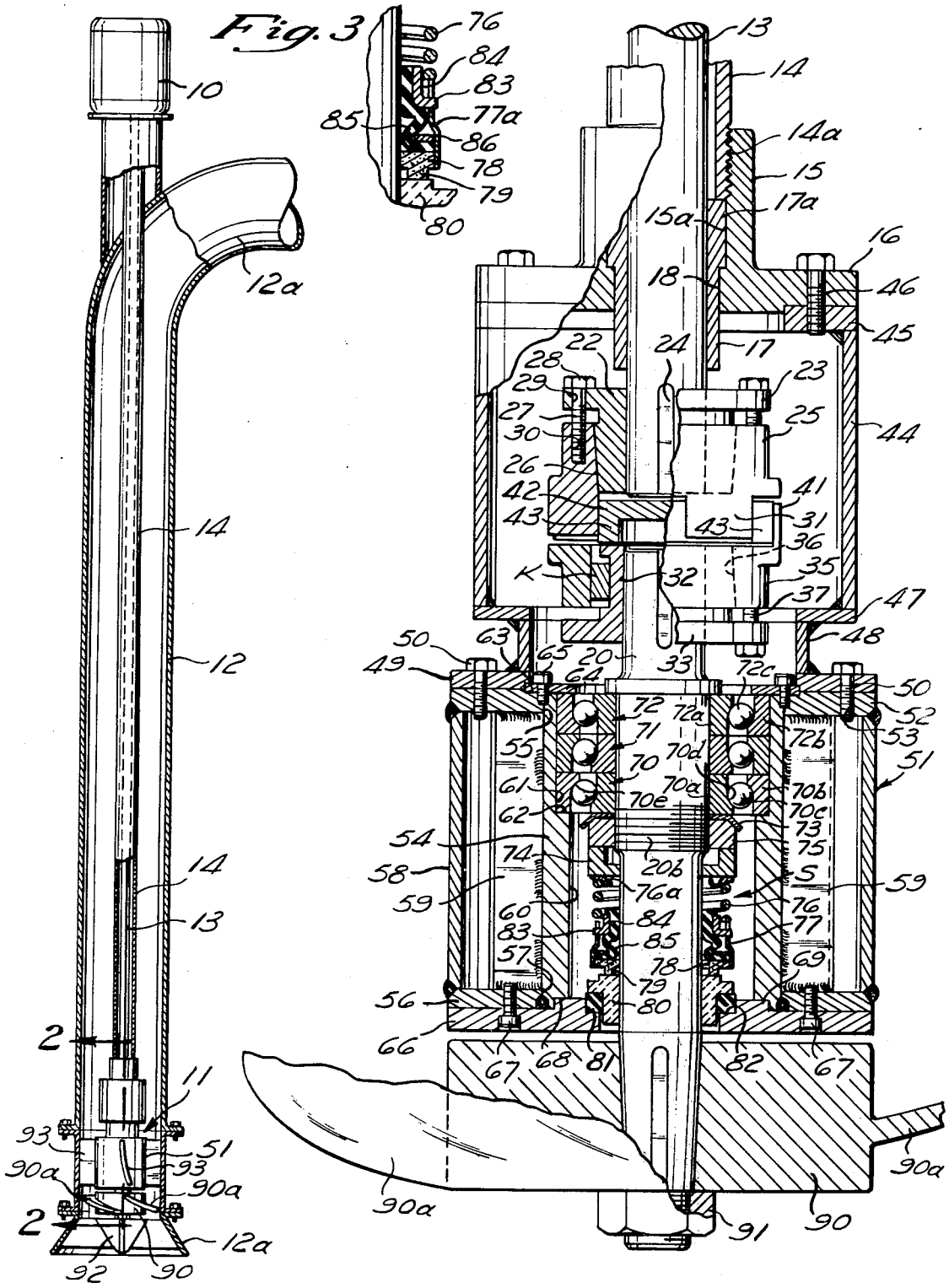
FIG. 1 is a vertical elevational view, with parts broken away for clarity, of a pumping installation in accordance with the present invention.
FIG. 2 is a vertical section taken along the line 2—2 in FIG. 1 at the pump end of this installation.
FIG. 3 is an enlarged fragmentary longitudinal section through the pump shaft seal in this installation.
Figure 4:
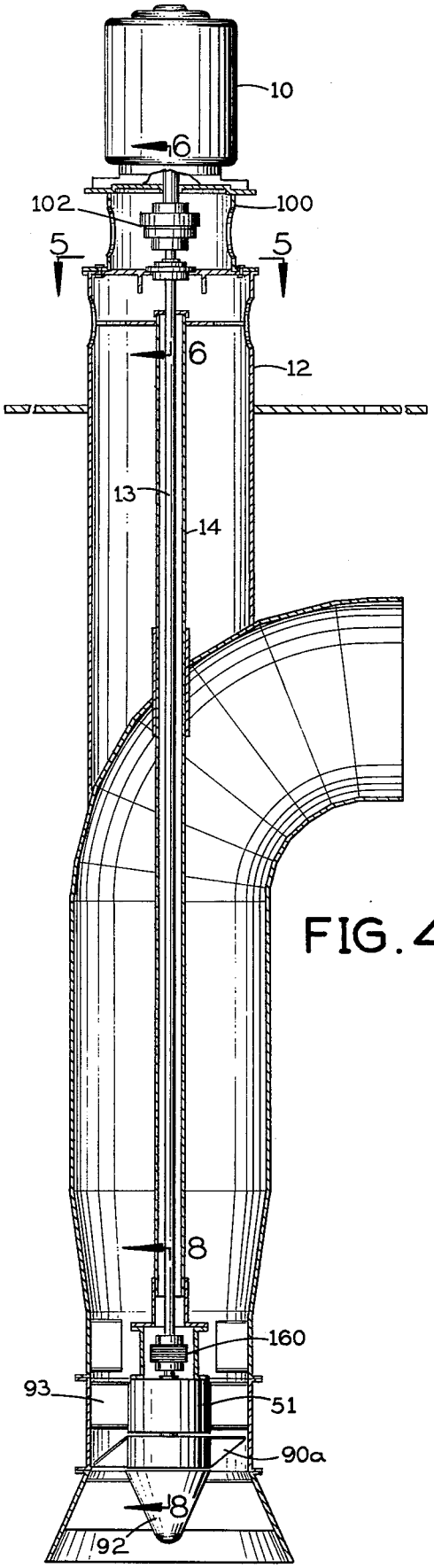
FIG. 4 is a vertical elevational view, with parts broken away for clarity, of a pumping installation in accordance with a modified embodiment of the present invention.
Figure 5:
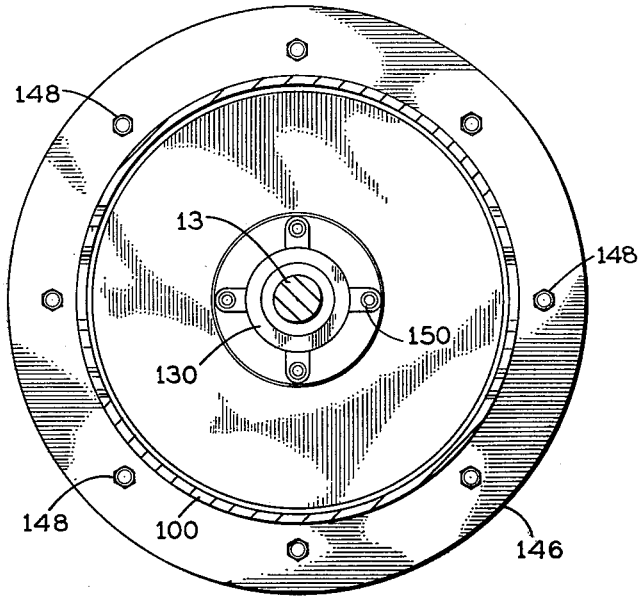
FIG. 5 is a horizontal sectional view taken along 5—5 of FIG. 4 and looking in the direction of the arrows.

Referring first to FIG. 1, in broad outline the pumping installation includes an electric motor 10 or other power source above ground, an axial-flow pump 11 located extending down through a cylindrical, vertical, pump column or casing 12, and an elongated, rotary, vertical drive shaft unit 13 driven by the motor 10 and extending down to the pump 11 for imparting the drive from the motor to the pump. The pump column or casing 12 may be inserted from above ground down into a ditch or other passageway or opening in the ground which carries water.

It is to be understood that the drive shaft unit 13 may consist of several shorter shafts connected end-to-end in any suitable manner, the details of which are not part of the present invention. The drive shaft unit 13 extends through a stationary vertical tube 14 located centrally inside the outer casing 12. Suitable bearings (not shown) support the drive shaft unit 13 for rotation inside the tube 14, these bearings being located at appropriate intervals along the vertical length of tube 14.

As shown in FIG. 2, the lower end of the tube 14 is externally screw-threaded at **14*a* and it is threadedly received in an upstanding, internally screw-threaded collar 15 on an annular top end plate 16. An elongated sleeve bearing 17 is snugly received in a central opening 18 in the end plate 16. This sleeve bearing has a slightly enlarged upper end segment 17*a* which is snugly received in a cylindrical recess 15*a* formed in the lower end of collar 15 below the latter's screw-threaded upper end. Preferably, the screw-threaded lower end of the tube 14 abuts against the upper end of sleeve bearing 17 and holds it down against the end plate 16 around the latter's opening 18, so as to positively position the bearing axially. The bearing 17 projects down below the top plate 16. The lower end of the drive shaft unit 13 extends down through the sleeve bearing 17** and is rotatable therein.

The upper end of the shaft 20 of pump 11 is spaced a short distance vertically below, and in vertical alignment with, the lower end of the drive shaft unit 13. The two shafts are coupled by a sliding jaw coupling, such as, for example, a "Type 3 Jaw Type Coupling" manufactured by Browning Mfg. Division, Emerson Electric Company, Maysville, Ken. This coupling imparts the rotation of the drive shaft unit 13 to the pump shaft 20 while at the same time permitting the drive shaft unit 13 to expand and contract axially (or longitudinally), due to temperature changes, without imparting such axial displacement to the pump shaft.

In this particular shaft coupling shown, an annular upper bushing 22 has a transverse, horizontal, radially outwardly projecting, annular flange 23 on its upper end. Below this top flange the bushing presents an inwardly and downwardly tapered periphery, and it is formed with a pair of diametrically opposed longitudinal slots (not shown) which separate it circumferentially into substantially semi-circular, opposite halves which engage the lower end of drive shaft unit from opposite sides. At its lower end the drive shaft unit 13 is formed with a longitudinal keyway 24, and the upper bushing 22 of the shaft coupling has a similar keyway on the inside (not shown) in alignment with the drive shaft keyway. A suitable key is received in these aligned keyways so as to permit relative longitudinal (or axial) displacement between the drive shaft unit 13 and bushing 22 before the bushing is pinched tightly against the drive shaft unit.

An annular upper jaw member 25 of the shaft coupling extends snugly around the upper bushing 22 below the latter's top flange 23. This upper jaw member has a tapered central opening 26 which is complementary to the taper on the outside of bushing 22. The upper jaw member 25 is coupled to the upper bushing 22 by a plurality of bolts 27, which have enlarged heads 28 overlying the top flange 23 on the upper bushing 22. These bolts extend down through respective openings 29 in flange 23 and they present screw-threaded lower ends which are threadedly engaged in complementary screw-threaded openings 30 formed in the upper end of jaw member 25. When these bolts are tightened, the tapered engagement between jaw member 25 and bushing 22 pinches the latter tightly against the drive shaft unit 13. The jaw member 25 and the bushing 22 are keyed to each other by means of a longitudinal key (not shown) which is received in a longitudinal slot on the inside of jaw member 25 and a registering longitudinal slot (not shown) formed in the outside of bushing 22.

The upper jaw member 25 at its lower end presents a plurality of circumferentially spaced, downwardly projecting, arcuate fingers or protrusions 31.

The lower half of the shaft coupling is essentially similar to the just-described upper half. It includes an annular lower bushing 32 with a transverse, horizontal flange 33 on its lower end and, an inwardly and upwardly tapered periphery above. This bushing is keyed to the upper end of the pump shaft 20 and it is longitudinally slotted so that its opposite arcuate halves can be pinched tightly against the pump shaft.

An annular lower jaw member 35 is keyed to the lower bushing 32 by a key K. The lower jaw member 35 has a tapered central opening 36 which is substantially complementary to the external taper on the lower bushing 32. Bolts 37 act between the lower jaw member 35 and the lower bushing 32 in the same manner as the bolts in the upper half of the shaft coupling, enabling the lower jaw member 35 to pinch the lower bushing 32 tightly against the pump shaft.

The lower jaw member 35 at its upper end presents a plurality of circumferentially spaced, upwardly projecting, arcuate fingers or protrusions 41 which are located between and circumferentially spaced from the downwardly projecting arcuate fingers 31 on the upper jaw member 25 of the shaft coupling.

A spacer 42, preferably of oil-impregnated brass, is engaged between the upper end and lower halves of the shaft coupling presenting a horizontal central segment located between the lower end face of drive shaft unit 13 and the upper end face of pump shaft 20 and a plurality of outwardly projecting, circumferentially spaced fingers 43 which are engaged between the arcuate fingers 31 and 41 on the upper and lower jaw members 25 and 35, respectively.

The just-described shaft coupling is enclosed within a housing which comprises:

the previously-mentioned top end plate 16;

an annular side wall 44 extending below plate 16 and connected to it by an upper annular, flat plate 45, which is welded to the top of wall 44 at the inside and extends horizontally inward therefrom, and bolts 46 fastening plate 45 to the underside of the top end plate 16;

a lower annular, flat plate 47, which is welded to the bottom of annular wall 44 at the inside and extends inward therefrom horizontally;

an annular side wall 48 (of smaller diameter than wall 44) welded to the bottom of plate 47 and extending downward therefrom;

and a flat, annular, bottom plate 49 welded to the lower end of wall 48 and extending horizontally outward therefrom.

The bottom plate 49 of the housing for the shaft coupling is fastened by bolts 50 directly to the top of a bearing housing 51. This housing comprises:

an annular, flat, horizontal top plate 52 having screw-threaded openings 53 which threadedly receive the attachment bolts 50;

an annular inside housing wall 54 extending down from the top plate 52 at the inside of the latter, with the cylindrical outer periphery of wall 54 at its upper end fitting snugly inside a circular central opening 55 in top plate 52;

an annular, flat horizontal, bottom plate 56 having a circular central opening 57 which snugly receives the lower end of the downwardly extending annular inside wall 54;

an annular outer wall 58 extending vertically between the top and bottom plates 52 and 56, respectively, and presenting a cylindrical outer periphery which registers with the outer peripheries of these plates;

and a plurality of circumferentially spaced, radially disposed, longitudinal reinforcing bars 59, which are welded at their inner longitudinal edges to the outside of annular wall 54, and are welded at their upper ends to the bottom of top plate 52, and are welded at their lower ends to the top of the bottom plate 56.

The reinforcing bars 59 are snugly engaged vertically between the end plates 52 and 56 of this housing and serve to position these end plates accurately with respect to the inside wall 54. After these reinforcing bars have been welded in place, the top end plate 52 and the bottom end plate 56 are welded directly to the inside wall 54 and to the outside wall 58.

The inside wall 54 of the bearing housing has a cylindrical bore 60 at its lower half and a cylindrical counterbore 61 at its upper half, with an annular upwardly-facing shoulder 62 being formed at the juncture between this bore and counterbore.

At the top of this housing the top plate 52 presents an annular recess or depression 63 in which is seated a retainer plate 64 for the pump shaft bearing (to be described). This retainer plate 64 is a flat, annular plate which extends horizontally inward across and beyond the top and face of the inside wall 54 of the bearing housing. Bolts 65 attach the retainer plate 64 to the top plate 52 of the bearing housing.

At the lower end of this housing a bottom retainer plate 66 is attached by bolts 67 directly to the underside of the bottom end plate 56 of the housing. At this location on the housing the inside housing wall 54 presents a shallow downwardly-facing recess or depression 68 at the inside which snugly receives an annular, upwardly projecting collar 69 on the bottom retainer plate 66.

In the embodiment illustrated, the pump shaft bearing consists of three ball bearing units 70, 71, 72 stacked vertically end-to-end between the upwardly-facing shoulder 62 on the inside wall 54 the bearing housing and the retainer plate 64 at the top. Each of these ball bearings is constructed to withstand axial thrusts on the pump shaft. It will be evident from FIG. 2 that the lower bearing 70 is designed to withstand upward thrusts on the pump shaft, while the upper bearing 72 and the middle bearing 71 are both designed to withstand downward thrusts. If desired, one of these three bearings can be a conventional ball bearing which is not designed to withstand substantial axial thrusts in either direction. What is important is that the bearing assembly for the pump shaft have means for withstanding an axial thrust in either direction.

The lower bearing unit 70 comprises an annular inner race **70*a* engaging the pump shaft 20, an annular outer race 70*b* seated snugly in the housing counterbore 61 immediately above the shoulder 62, and balls 70*c* engaged radially between these races. The inner race 70*a* presents and upwardly-facing, annular, concave seat 70*d* which engages the balls 70*c* from below. The outer race 70*b* presents a downwardly-facing, annular, concave seat 70*e* which engages the balls 70*c* from above. With these seats on the races arranged in this manner, this bearing is designed to withstand upward thrusts on the pump shaft 20**.

The other two bearing units 71 and 72 have similar arrangements of inner and outer races and balls, except that the axial positions of the respective ball-engaging seats are reversed from the arrangement in bearing 70, so that each bearing 71 and 72 is designed to withstand downward thrusts on the pump shaft 20.

The top face of the outer race **72*b* of bearing 72 engages the underside of the retainer plate 64. The top face of the inner race 72*a* of bearing 72 engages the underside of a transverse, annular flange 20*a* on the pump shaft 20**.

With this arrangement, the bearing units 70, 71, 72 are supported within the bearing housing 51 and they support the pump shaft 20 for rotation, as well as taking up axial thrusts on the pump shaft in either direction vertically.

In accordance with the present invention, a shaft seal S for the pump shaft is provided between the lowermost pump shaft bearing 70 and the bottom end plate 66 of the bearing housing. This shaft seal may be a "John Crane Type 1" seal sold by Crane Packing Co., Morton Grove, Ill., and depicted in that company's bulletin S-255-3, or it may be a similar type of carbon-ceramic shaft seal made by other companies.

This shaft seal is located below a lock nut 75, which is threadedly mounted on a screw-threaded portion **20*b* of the pump shaft 20 directly below a washer 73 engaging the bottom of the lowermost bearing unit 70. An annular spacer 74 engages the bottom of the nut 75 and encircles the shaft just below its screw threads 20*b***.

The shaft seal includes a compression coil spring 76 whose upper end engages a retainer **76*a* that abuts against the bottom of the spacer 74. The lower end of this spring is seated against the upper end of an annular retainer 77 which holds a carbon mating ring 78 at its lower end. The nut 75, spacer 74, retainer 77 and mating ring 78 are rotatable, as a unit, in unison with the pump shaft 20**.

The mating ring 78 has a downwardly-offset, annular central segment 79 which bears down against a stationary ceramic ring 80. The engaging surfaces of the carbon and ceramic rings 78 and 80 are lapped to provide a fluid-tight seal around the pump shaft.

The stationary ring 80 is seated in a ring-shaped holder 81 of rubber-like material, which is mounted in an upwardly-facing, central, annular recess 82 in the bottom retainer plate 66 of the bearing housing 51.

The annular retainer 77 at its upper end has circumferentially-spaced, upwardly-facing notches or recesses which snugly receive corresponding radially outwardly-projecting fingers 83 on an annular driving band 84, which extends up from the retainer 77 inside the coil spring 76.

An annular, flexible and resilient bellows 85 of rubber-like material surrounds the pump shaft 20 and is held tightly against the shaft around the latter's entire circumference by the driving band 84 near its upper end. The lower end of this annular bellows is held against the top of the rotating mating ring 78 by the retainer 77. As best seen in FIG. 3, the retainer 77 is offset radially inward at **77*a* and just below this location a flat annular disc 86, which fits snugly inside the retainer 77, holds the radially outwardly-extending lower end lip of bellows 85 snugly against the top of ring 78. The bellows 85** has one or more folds along its length.

This particular type of shaft seal has been found to be advantageous in preventing the entry of foreign particles, normally found in water, from entering the bearings 70–72 and interfering with their extremely vital function of centering and rotatably supporting the pump shaft. In pumping installations of the axial-flow type prior to the present invention, the shaft seal has been the principal trouble spot because of its tendency to cause excessive wear on the pump shaft, which had the result of keeping the pump out of operation frequently and for relatively long periods of time. With the improved operation made possible by this particular shaft seal, the bearings 70–72 properly center the pump shaft 20 and keep it aligned axially with the drive shaft unit 13 and produce no excessive wear on the pump shaft. In turn, this makes possible the use of the slidable jaw coupling between these shafts, which prevents the axial expansion and contractions of the drive shaft unit 13 from being imparted to the pump shaft.

At its lower end, below the bottom retainer plate 66 on the bearing housing 51, the pump shaft 20 carries a rotary axial-flow impeller 90 which, as shown in FIG. 1, has several blades **90*a* with a close running fit inside the outer casing 12. A nut 91 (FIG. 2) holds the impeller on the pump shaft, and a deflection cone 92 (FIG. 1) extends centrally below the impeller. The casing 12 has an outwardly and downwardly flared section 12*a* at its extreme lower end surrounding the central cone for guiding water into the casing as the impeller rotates. A plurality of circumferentially spaced, longitudinal flow divider plates 93 are welded to the outside of the bearing housing 51 and to the inside of the casing 12. These flow divider plates direct the water that is displaced upward by the impeller blade 90a** to flow substantially longitudinally of the pump assembly and largely eliminate the circumferential component of flow that may be imparted to the water by the impeller blades.

In the operation of this pumping apparatus, the pump impeller 90 displaces upwardly through the longitudinal passages between the divider plates 93 and then up along the interior of the casing 12 around the outside of the tube 14 which houses the drive shaft unit 13. Tube 14 and housings 44 and 54 are filled with oil to lubricate the shafts, coupling and bearings, and in the embodiment illustrated the pressure head of this oil is greater than, or at least substantially equal to, the water head pressure. The casing has a transversely curved upper end 12a through which the water is discharged. Any longitudinal expansion or contraction of the long drive shaft unit 13 is accommodated by the sliding jaw coupling at its lower end without imparting those forces to the pump shaft. The bearing assembly 70–72 centers the pump shaft 20 in proper vertical alignment with the drive shaft unit 13 and also takes up any axial thrusts on the pump shaft due to the pumping action. With the pump shaft held in the proper position, the shaft seal S is able to perform its sealing function effectively over a much longer lifetime than could be achieved reliably with previous shaft seals used on axial-flow pumps which tended to produce wear grooves in the shaft that, in turn, caused leakage at the shaft seal.

It is to be understood that structural modifications differing from the particular arrangement shown may be provided. For example, when the water head pressure is greater than the oil head pressure, the shaft seal should be reversed end-to-end from the position shown in the accompanying drawing. Also, the sliding jaw coupling may differ from the particular one shown, and this is also true of the carbon-ceramic shaft seal.

FIGS. 4 through 9 illustrating a modified embodiment of the invention in which the same reference numerals are used to designate like parts as compared to FIGS. 1–3. Only the differences in FIGS. 4–8 as compared to FIGS. 1–3 will be described, and it will be understood that the remaining structure and functions are substantially the same as have been described in connection with FIGS. 1–3.

Between the motor 10 and the casing 12, there is affixed a housing 100 which contains a slidable coupling means 102 in the form of a slidable jaw coupling. The slidable jaw coupling 102 is shown in detail in FIGS. 6 and 7. There is an upper shaft section 104 which extends down from the motor 10 and is coupled to the main drive shaft unit 13 by the slidable jaw coupling 102. The lower end of shaft section 104 is separated from the upper end of shaft 13 by a rubber pad 106 which is compressible so that it will yield when the shaft 13 expands due to increased temperatures. The separation of the ends of shaft section 104 and shaft unit 13 allows those shafts to expand and contract freely with temperature changes.

Figure 7:
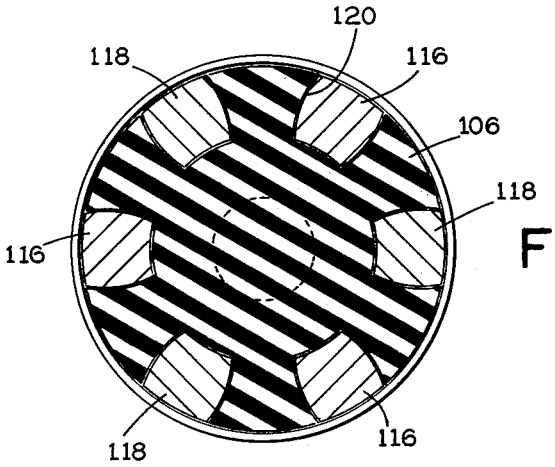
FIG. 7 is a horizontal sectional view through a coupling taken along line 7—7 of FIG. 6 and looking in the direction of the arrows.

A jaw element 108 is affixed firmly to the lower end of shaft section 104 as with a set screw 110. Another jaw element 112 is affixed firmly to the upper end of shaft unit 13 as with a set screw 114. The jaw elements 108 and 112 have inter-engaging fingers such as fingers 116 and 118 which are received in slots 120 in the separating pad 106 as shown in FIG. 7. There may be three fingers 118 for jaw element 112 and three fingers 116 for jaw element 108 as shown. The fingers slidably couple the two jaw elements together, but allow them to move slightly axially of the shaft since there is small space 122 at the lower ends of fingers 116 and another small space 124 at the upper end of fingers 118. A keyway 126 is formed in shaft section 104, and another keyway 128 is formed in shaft unit 113. These keyways receive keys (not shown) provided on the interior of jaw elements 108 and 112.

Shaft unit 13 extends through a bearing assembly 130 which acts as both a radial and an axial bearing for the shaft unit 13. A collar 132 is firmly affixed to shaft unit 13 as with a set screw 134. The collar 132 engages the inner race 136 of bearing assembly 130 so that the shaft unit 13 is suspended from the bearing assembly 130. Slanted rollers 138 engage both the inner race 136 and the outer races 140 and act to absorb both radial and axial thrust.

The housing 100 for the slidable jaw coupling 102 has a flange 142 which is connected with bolts 144 to the motor 10 and another flange 146 which is connected with bolts 148 to the casing 12. The bearing assembly 130 is connected by bolts 150 to the top end 152 of the casing 12.

Figure 9:
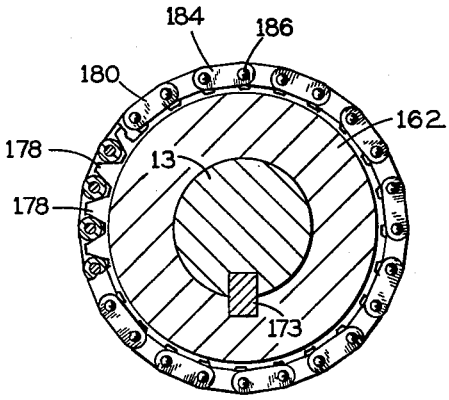
FIG. 9 is a horizontal sectional view of a coupling taken along line 9—9 of FIG. 8.
Figure 6:
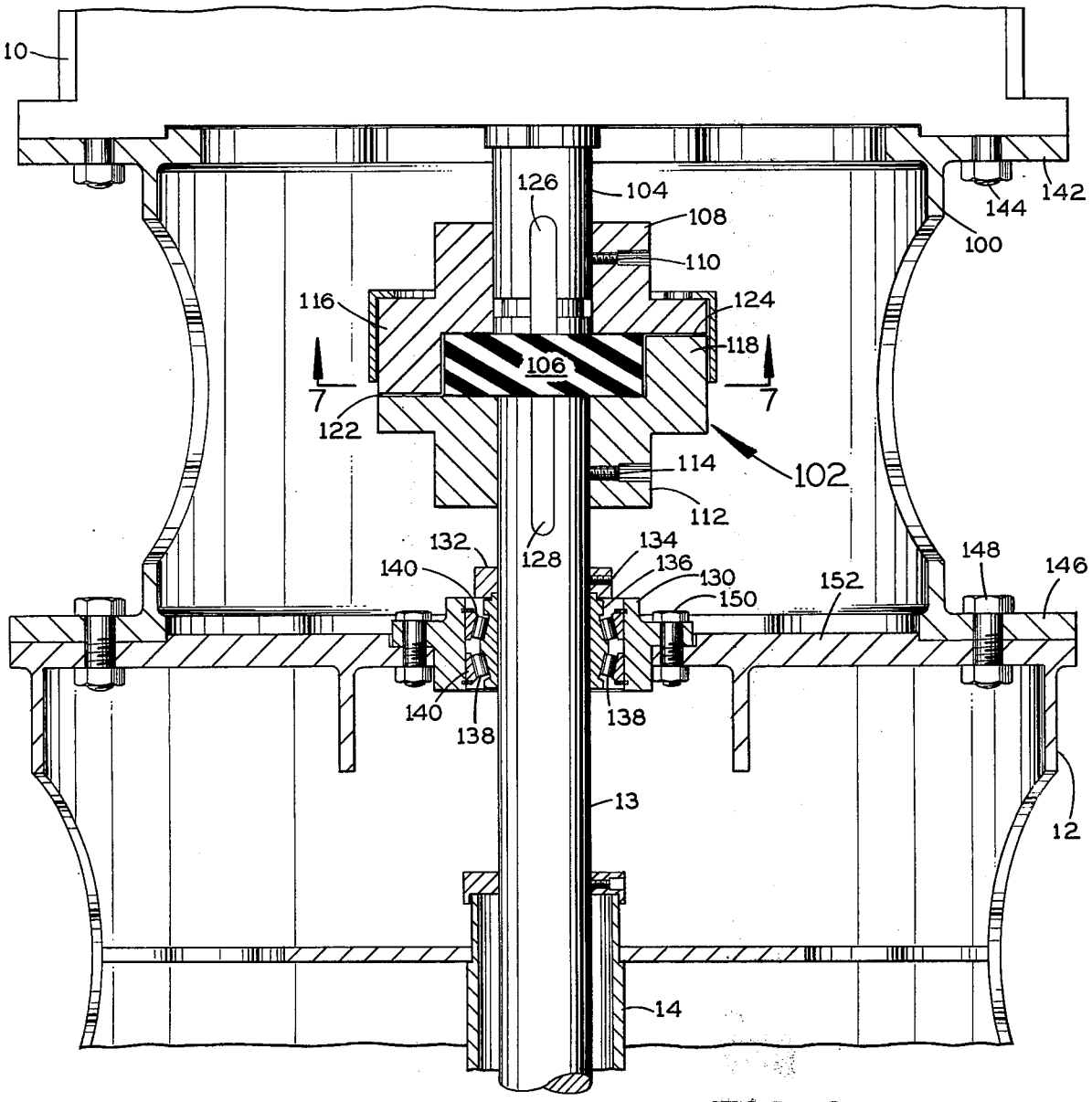
FIG. 6 is a vertical sectional view taken along lines 6—6 of FIG. 4 and looking in the direction of the arrows.
Figure 8:
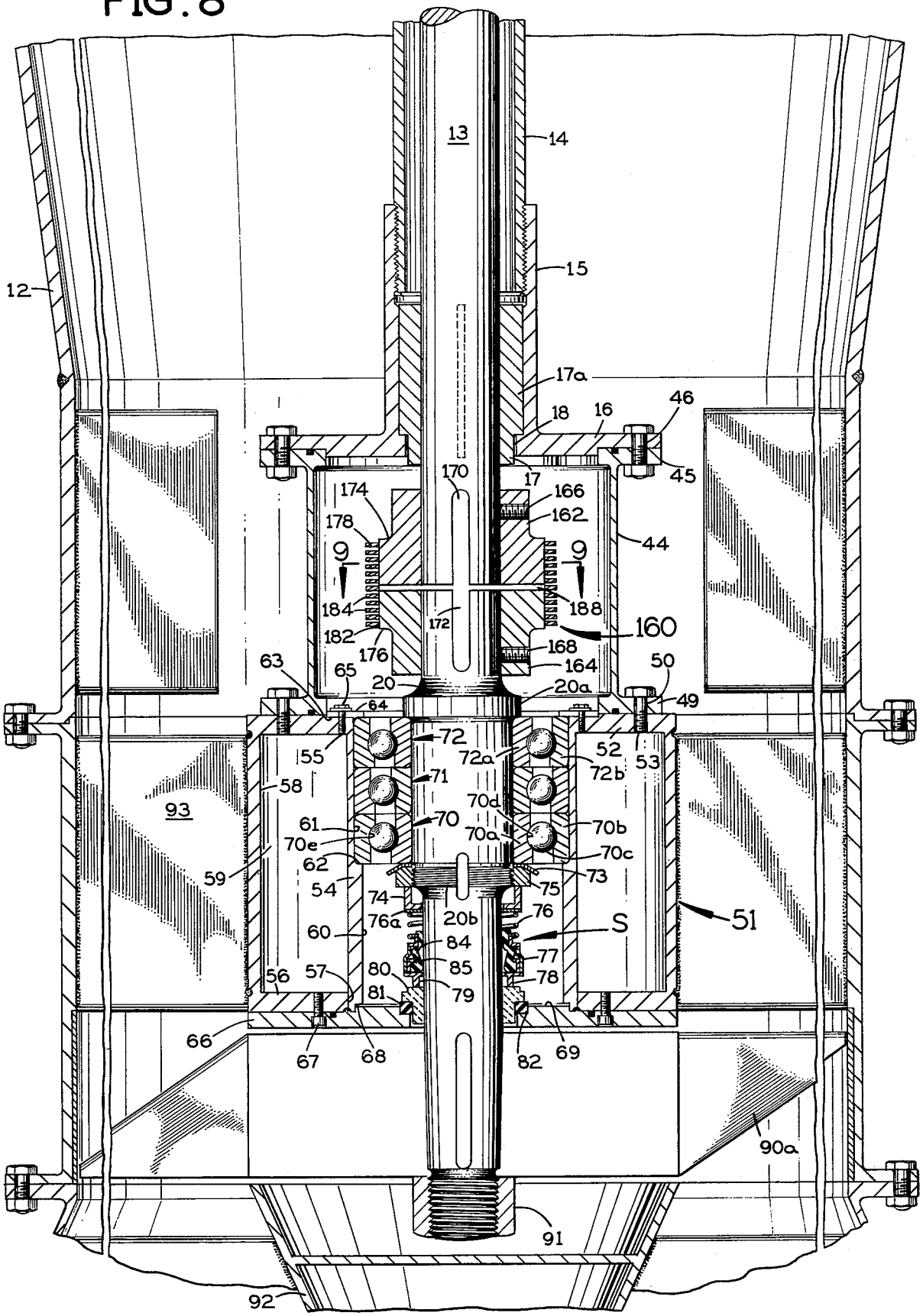
FIG. 8 is a vertical sectional view taken along line 8—8 at the bottom of FIG. 4 and looking in the direction of the arrows.

Another slidable coupling means 160 is provided at the lower end of shaft unit 13 and is shown in FIGS. 1, 8 and 9. The coupling 160 is a slidable chain coupling which forms an alternative for the slidable jaw coupling utilized at the bottom of shaft 13 in the embodiment of FIGS. 1–3.

The slidable chain coupling 160 as shown in FIGS. 8 and 9 includes an upper coupling element 162 and a lower coupling element 164. Upper coupling element 162 is affixed firmly to the shaft unit 13 as with a set screw 166. Lower coupling element 164 is affixed firmly to the upper end of the shaft 20 of pump 11 as with a set screw 168. Keyways 170 and 172 are provided in the lower end of shaft unit 13 and the upper end of shaft 20 for receiving keys such as key 173(FIG. 9) on the interior side of coupling elements 162 and 164.

The coupling elements 162 and 164 are annular members with circular peripheral portions 174 and 176. Peripheral portion 174 has teeth 178 with mesh with a circular chain 180 of the bicycle chain type which encircles the peripheral portion 174. This chain 180 also encircles the peripheral portion 176 and the latter portion also has teeth 182 which mesh with the chain 180. The chain 180 has vertically spaced link elements 184 which are connected together as with rivets or pins 186 in such a manner that there is some play in the chain 180. Thus, the two coupling elements 162 and 164 can slide vertically relative to each other and relative to the chain 180 in order to allow for expansion and contraction of the shaft unit 13 and shaft 20 due to temperature changes.

As in FIGS. 1–3, the lower end of shaft unit 13 is separated from the upper end of shaft 20 by a small space 188 which also extends between the coupling elements 162 and 164.

Thus, in both embodiments of the invention, the main shaft unit 13 is coupled to the shaft 20 of pump 11 by a slidable coupling means which in FIGS. 1–3 is a slidable jaw coupling and in FIGS. 4–9 is a slidable chain coupling. In both embodiments, the housing for the slidable coupling means at the lower end of shaft unit 13, the housing for the bearings 70, 71 and 72, and the tube 14 are substantially filled with oil for lubrication purposes. Both embodiments have a shaft seal S at the lower end of the housing 51.

I claim:

1. In a pumping apparatus comprising:
a power drive means,
an annular casing at least several feet long extending down from said power drive means,
a rotary drive shaft unit at least several feet long driven by said power drive means and extending down inside said casing,
and an axial flow pump in the lower end of said casing having a rotary pump shaft below the lower end of said drive shaft unit,
the improvement which comprises the combination of:
a slidable coupling means connecting the lower end of said drive shaft unit to the upper end of said pump shaft for imparting the rotation of the drive shaft unit to the pump shaft and at the same time permitting axial expansion and contraction of the drive shaft unit relative to the pump shaft,
an anti-friction radial bearing assembly engaging the pump shaft below said coupling and positioning the pump shaft in vertical alignment with said drive shaft unit;
a fluid seal for the pump shaft below said bearing assembly, said fluid seal comprising a fixed ring which rotatably passes the pump shaft, a second ring which sealingly engages said fixed ring around the complete circumference of the pump shaft, a spring biasing said second ring against said fixed ring and coupling said second ring to said pump shaft for rotation with the pump shaft, and a flexible, elastomeric, annular bellows clamped to the pump shaft around its complete circumference at a location spaced from said rings and having a radially disposed annular end which engages said second ring;
a tube surrounding said drive shaft unit inside said casing;
a housing for the slidable coupling attached to the lower end of the tube;
and a housing for the bearing assembly and the pump shaft seal attached to the lower end of said housing for the coupling;
said housings and said tube being filled with oil to lubricate said shaft unit, said coupling and said bearing assembly.

2. A pumping apparatus according to claim 1, wherein said bearing assembly comprises combined radial and axial thrust bearing units which respectively withstand downward and upward axial thrusts on the pump shaft.

3. A pumping apparatus according to claim 2, wherein said housing for said bearing assembly and said shaft seal comprises:
an annular outer wall;
an annular inner wall spaced radially inward from said outer wall and engaging said bearing assembly from the outside;
annular top and bottom walls attached rigidly to said outer and inner walls and extending between them;
and a plurality of longitudinal reinforcing plates extending between said top and bottom walls at different circumferential locations around said inner wall, said plates being rigidly attached to said inner wall and to said top and bottom walls.

4. A pumping apparatus according to claim 3, wherein said inner wall presents an upwardly-facing, annular shoulder at the inside which engages and supports said bearing assembly from below, and said housing has an annular retainer plate extending radially inward from the top of said inner wall and engaging said bearing assembly from above.

5. A pumping apparatus according to claim 4, wherein said pump shaft has an annular flange overlying the top of said bearing assembly at the inside of the latter, and further comprising a nut threaded onto said pump shaft directly below said bearing assembly.

6. A pumping apparatus according to claim 5, wherein said spring in the fluid seal acts between said nut and said second ring.

7. A pumping apparatus according to claim 6, and further comprising an annular bottom retainer plate attached to the bottom wall of said housing and extending radially inward from the inner wall of said housing, said fixed ring in the shaft seal being mounted on and supported by said bottom retainer plate below said second ring.

8. A pumping apparatus according to claim 1 wherein said housing for said bearing assembly and said shaft seal comprises:
an annular outer wall;
an annular inner wall spaced radially inward from said outer wall and engaging said bearing assembly from the outside;
annular top and bottom walls attached rigidly to said outer and inner walls and extending between them;
and a plurality of longitudinal reinforcing plates extending between said top and bottom walls at different circumferential locations around said inner wall, said plates being rigidly attached to said inner wall and to said top and bottom walls.

9. A pumping apparatus according to claim 8, wherein said inner wall presents an upwardly-facing, annular shoulder at the inside which engages and supports said bearing assembly from below, and said housing has an annular retainer plate extending radially inward from the top of said inner wall and engaging said bearing assembly from above.

10. A pumping apparatus according to claim 1, wherein said pump shaft has an annular flange overlying the top of said bearing assembly at the inside of the latter, and further comprising a nut threaded onto said pump shaft directly below said bearing assembly.

11. A pumping apparatus according to claim 10, wherein said spring in the fluid seal acts between said nut and said second ring.

12. A pumping apparatus according to claim 8, and further comprising an annular bottom retainer plate attached to the bottom wall of said housing and extending radially inward from the inner wall of said housing, said fixed ring in the shaft seal being mounted on and supported by said bottom retainer plate below said second ring.

13. A pumping apparatus according to claim 1, and further comprising an annular bottom retainer plate attached to the bottom of said housing for the bearing assembly and the pump shaft seal, said retainer plate supporting said fixed ring in the shaft seal beneath said second ring.

* * * * *